US010344621B2

(12) United States Patent
Dreischarf et al.

(10) Patent No.: US 10,344,621 B2
(45) Date of Patent: Jul. 9, 2019

(54) SYSTEM AND METHOD OF LIMITING AXIAL MOVEMENT BETWEEN COMPONENTS IN A TURBINE ASSEMBLY

(71) Applicant: General Electric Company, Schenectady, NY (US)

(72) Inventors: Derek Thomas Dreischarf, Bellbrook, OH (US); Courtland Earl Pegan, Jr., Norwood, OH (US); Scott Patrick Ryczek, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 821 days.

(21) Appl. No.: 14/395,938

(22) PCT Filed: Apr. 26, 2013

(86) PCT No.: PCT/US2013/038464
§ 371 (c)(1),
(2) Date: Oct. 21, 2014

(87) PCT Pub. No.: WO2013/163581
PCT Pub. Date: Oct. 31, 2013

(65) Prior Publication Data

US 2015/0132054 A1 May 14, 2015

Related U.S. Application Data

(60) Provisional application No. 61/639,563, filed on Apr. 27, 2012.

(51) Int. Cl.
*F01D 25/24* (2006.01)
*F01D 25/26* (2006.01)

(52) U.S. Cl.
CPC ..... *F01D 25/243* (2013.01); *F01D 25/24* (2013.01); *F01D 25/246* (2013.01); *F01D 25/26* (2013.01);
(Continued)

(58) Field of Classification Search
CPC ..... F01D 25/243; F01D 25/246; F01D 25/28; F01D 25/24; F01D 25/26; F16B 2/20;
(Continued)

(56) References Cited

U.S. PATENT DOCUMENTS 3,860,358 A * 1/1975 Cavicchi ..... F01D 11/08 277/411
4,247,248 A * 1/1981 Chaplin ..... F01D 11/24 415/136
(Continued)

FOREIGN PATENT DOCUMENTS

CN 102102588 A 6/2011
CN 102171100 A 8/2011
(Continued)

OTHER PUBLICATIONS

Unofficial English translation of Japanese Office Action issued in connection with corresponding JP Application No. 2015-509195 dated Dec. 1, 2015.
(Continued)

*Primary Examiner* — Theodore V Adamos
(74) *Attorney, Agent, or Firm* — General Electric Company; Brian Overbeck

(57) ABSTRACT

A system for use in limiting axial movement between a hanger and a fairing assembly within a turbine assembly is provided. The hanger includes an inner radial hanger bend portion that defines a hook channel therein. The fairing assembly includes an outer surface, a hook member extending from the outer surface to mate with the hook channel, and a circumferential groove defined in the outer surface such that at least a portion of the hanger bend portion is positioned between the circumferential groove and the hook member. The system includes a retention member sized for insertion into the circumferential groove, wherein the retention member is configured to extend from the circumferen-
(Continued)

tial groove and press against the hanger bend portion to facilitate maintaining the hook member within the hook channel.

15 Claims, 13 Drawing Sheets

(52) U.S. Cl.
CPC ..... *F05D 2230/60* (2013.01); *Y10T 29/49959* (2015.01); *Y10T 403/7075* (2015.01)

(58) Field of Classification Search
CPC .... F16B 2/22; F16B 2/24; F16B 2/241; F16B 2/243; F16B 2/245; F16B 21/16; F16B 21/18; F16B 21/183; F16B 21/186; Y10T 29/49959; Y10T 403/7075; F05D 2230/60
USPC ..... 415/191, 193, 196, 208.1, 208.2, 209.1, 415/209.2, 209.3, 211.1, 213.1, 220
See application file for complete search history.

(56) References Cited

U.S. PATENT DOCUMENTS 4,573,866 A * 3/1986 Sandy, Jr. ..... F01D 11/08 415/116
5,192,185 A * 3/1993 Leonard ..... F01D 11/08 415/170.1
5,197,853 A * 3/1993 Creevy ..... F01D 11/005 29/889.22
5,553,999 A * 9/1996 Proctor ..... F01D 25/246 415/134
5,641,267 A * 6/1997 Proctor ..... F01D 11/08 415/173.1
5,669,757 A * 9/1997 Brackett ..... F01D 25/246 415/209.2
5,738,490 A * 4/1998 Pizzi ..... F01D 11/005 415/139
6,062,813 A * 5/2000 Halliwell ..... F01D 9/04 415/173.1
6,164,656 A * 12/2000 Frost ..... F01D 11/005 277/312
6,364,606 B1 4/2002 Rice et al.
6,418,727 B1 * 7/2002 Rice ..... F01D 9/023 60/799
6,435,820 B1 * 8/2002 Overberg ..... F01D 25/246 415/1
6,547,257 B2 * 4/2003 Cromer ..... F01D 9/023 277/355
6,575,697 B1 * 6/2003 Arilla ..... F01D 11/005 415/173.1
6,672,833 B2 1/2004 MacLean et al.
6,699,011 B2 * 3/2004 Cot ..... F01D 9/04 415/173.1
6,726,446 B2 * 4/2004 Arilla ..... F01D 25/246 415/138
6,895,757 B2 * 5/2005 Mitchell ..... F01D 11/005 60/753
6,918,743 B2 * 7/2005 Gekht ..... F01D 9/04 415/139
6,997,673 B2 * 2/2006 Morris ..... F01D 9/04 415/1
7,011,493 B2 * 3/2006 Marchi ..... F01D 9/04 415/116
7,334,980 B2 * 2/2008 Trinks ..... F01D 9/04 415/1
7,360,989 B2 * 4/2008 Amiot ..... F01D 9/04 415/138
7,374,395 B2 * 5/2008 Durocher ..... F01D 9/04 415/115
7,452,183 B2 * 11/2008 Ruthemeyer ..... F01D 25/246 415/135
7,527,469 B2 * 5/2009 Zborovsky ..... F01D 9/041 277/412
7,721,433 B2 5/2010 Thompson et al.
8,033,786 B2 * 10/2011 Durocher ..... F01D 9/042 415/189
8,192,149 B2 * 6/2012 Audeon ..... F01D 11/08 24/542
8,328,511 B2 12/2012 Hernandez Russe et al.
8,641,371 B2 * 2/2014 Nakamura ..... F01D 11/18 415/139
8,840,061 B2 9/2014 Caruel et al.
8,876,042 B2 11/2014 Lachapelle et al.
8,961,117 B2 * 2/2015 Garin ..... F01D 11/005 415/173.6
2005/0002779 A1 * 1/2005 Tanaka ..... F01D 5/225 415/173.1
2005/0232760 A1 * 10/2005 Wagner ..... F01D 5/3015 415/191
2006/0216146 A1 * 9/2006 Thompson ..... F01D 11/08 415/213.1
2006/0239814 A1 * 10/2006 Uwami ..... F01D 11/005 415/134
2007/0031245 A1 * 2/2007 Ruthemeyer ..... F01D 9/04 415/134
2007/0160471 A1 7/2007 Welch
2008/0106046 A1 * 5/2008 Datta ..... F16J 15/0887 277/644
2008/0127491 A1 * 6/2008 Lee ..... F01D 11/08 29/888.02
2008/0260524 A1 * 10/2008 Khanin ..... F01D 11/005 415/177
2009/0010758 A1 * 1/2009 Wunderlich ..... F01D 11/08 415/214.1
2009/0142180 A1 * 6/2009 Munson ..... F01D 11/001 415/111
2009/0208322 A1 * 8/2009 McCaffrey ..... F01D 11/125 415/113
2010/0074745 A1 * 3/2010 Jones ..... F01D 11/24 415/209.3
2010/0080699 A1 * 4/2010 Pietrobon ..... F01D 11/005 415/220
2010/0247298 A1 * 9/2010 Nakamura ..... F01D 11/18 415/173.1
2011/0044801 A1 * 2/2011 Di Paola ..... F01D 9/04 415/173.1
2012/0137705 A1 * 6/2012 Ura ..... F01D 11/08 60/796
2013/0223990 A1 * 8/2013 Cloarec ..... F01D 5/26 415/119
2014/0050577 A1 * 2/2014 Dimmick, III ..... F01D 5/066 415/208.1
2015/0132123 A1 * 5/2015 Stricker ..... F01D 9/02 415/209.2

FOREIGN PATENT DOCUMENTS

EP 1707749 A2 10/2006
FR 2980235 A1 3/2013
JP 2006275044 A 10/2006
JP 2006275045 A 10/2006
JP 2011001951 A 1/2011

OTHER PUBLICATIONS

Unofficial English Translation of Chinese Office Action issued in connection with corresponding CN Application No. 201380022269.3 dated Jul. 31, 2015.
International Search Report and Written Opinion issued in connection with corresponding PCT Application No. PCT/US2013/038464 dated Aug. 16, 2013.

* cited by examiner

SYSTEM AND METHOD OF LIMITING AXIAL MOVEMENT BETWEEN COMPONENTS IN A TURBINE ASSEMBLY

CROSS-REFERENCE TO RELATED APPLICATIONS

This application is a non-provisional application and claims priority to U.S. Provisional Patent Application Ser. No. 61/639,563 filed Apr. 27, 2012 for "TURBINE FRAME HANGER LOCK ASSEMBLY AND METHOD", which is hereby incorporated by reference in its entirety.

BACKGROUND OF THE INVENTION

This invention relates generally to gas turbine engines, and more specifically to turbine frame hanger lock assemblies and methods of assembling the same.

At least some known gas turbine engines include a frame that supports a rotor assembly. For example, gas turbine engines may include one or more rotor shafts supported by bearings which, in turn, may be supported by generally annular engine frames. An engine frame may include a generally annular casing spaced radially outwardly from an annular hub, with a plurality of circumferentially spaced apart struts extending therebetween. In some frame applications it may be necessary to protect the struts with fairings that have higher temperature capability. Because temperature variances can cause metals to expand and contract, it is desirable to separate high temperature engine components such as the flow path components, from comparatively low temperature peripheral components such as the frame components. To attach flow path components to the frame components, one or more hangers are used. The hangers serve to attenuate heat transfer from flow path components to frame components. Primarily, these hangers serve to affix flow path components in predetermined positions relative to frame components.

In some implementations, hangers are annular components with a curved cross-section. The outermost surface of the hangers contain apertures and are fastened (e.g., with bolts threaded through the apertures) to the frame of the turbine engine. The innermost surface of the hangers can be fastened to the flow path components, also utilizing apertures for receiving fasteners (e.g., bolts). In some cases, a single hanger may be used to attach a single flow path component to a frame component. In other cases, a single hanger may be used to attach multiple flow path components to a frame component. Each hanger conventionally requires a number of fasteners, adding a significant time burden to installation. Furthermore, the number of hangers and corresponding large quantity of fasteners contribute to the overall weight of the turbine engine. Even further, the use of bolts to attach hangers to various flow path and frame components inherently requires penetration of both the hangers and the respective components, increasing the potential for stress related failures in the gas turbine engine.

BRIEF DESCRIPTION OF THE INVENTION

In one aspect, a system for use in limiting axial movement between a hanger and a fairing assembly within a turbine assembly is provided. The hanger includes an inner radial hanger bend portion that defines a hook channel therein. The fairing assembly includes an outer surface, a hook member extending from the outer surface to mate with the hook channel, and a circumferential groove defined in the outer surface such that at least a portion of the hanger bend portion is positioned between the circumferential groove and the hook member. The system includes a retention member sized for insertion into the circumferential groove, wherein the retention member is configured to extend from the circumferential groove and press against the hanger bend portion to facilitate maintaining the hook member within the hook channel.

In another aspect, a turbine assembly is provided. The turbine assembly includes a hanger including an inner radial hanger bend portion that defines a hook channel therein and a fairing including an outer surface, a hook member extending from said outer surface to mate with said hook channel, and a groove defined in said outer surface such that a portion of said hanger bend portion is positioned between said groove and said hook member. The assembly also includes a retention member sized for insertion into said groove, wherein said retention member is configured to extend from said groove and press against said hanger bend portion to facilitate maintaining said hook member within said hook channel.

In yet another aspect, a method of limiting axial movement between a hanger and a fairing within a turbine assembly is provided. The method includes extending a bend portion of the hanger to define a receiving channel therein, extending a hook member from an outer surface of the fairing to mate with the receiving channel, defining a groove in the outer surface such that at least a portion of the hanger bend portion is positioned between the groove and the hook member, inserting a retention member into the groove, and extending the retention member from the groove to press against the hanger bend portion of the hanger to facilitate maintaining the hook member within the receiving channel.

BRIEF DESCRIPTION OF THE DRAWINGS

FIGS. 1-20 show exemplary embodiments of the assembly and method described herein.

FIG. 1 is a schematic perspective view of a turbine frame hanger and a collection of fairing sections (e.g., flow path components) according to an embodiment;

FIG. 2 is a schematic perspective view of a turbine frame hanger as it is mounted to a collection of fairing sections according to an embodiment;

FIG. 3 is a schematic cross-sectional view of a turbine frame hanger as it is mounted to a fairing section, according to an embodiment;

FIG. 4 is a schematic cross-sectional view of a turbine frame hanger as it is mounted to a fairing section, according to an embodiment;

FIG. 5 is a schematic cross-sectional view of a turbine frame hanger as it is mounted to a fairing section, according to an embodiment;

FIG. 6 is a schematic cross-sectional view of a turbine frame hanger as it is mounted to a fairing section, according to an embodiment;

FIG. 7 is a schematic cross-sectional view of a turbine frame hanger as it is mounted to a fairing section, illustrating a scalloped opening for receiving a retention member, according to an embodiment;

FIG. 8 is a schematic cross-sectional view of a turbine frame hanger as it is mounted to a fairing section, illustrating a retention member inserted through a scalloped opening, according to an embodiment;

FIG. 9 is a schematic perspective view of a turbine frame hanger as it is mounted to multiple fairing sections, illustrating a retention member inserted through a scalloped opening, according to an embodiment;

FIG. 10 is a schematic perspective view of a turbine frame hanger as it is mounted to multiple fairing sections, illustrating a retention member inserted through a scalloped opening, according to an embodiment;

FIG. 11 is a schematic perspective view of a multi-turn retention member, according to an embodiment;

FIG. 12 is a schematic perspective view of multiple segmented retainers, according to an embodiment;

FIG. 13 is a schematic perspective view of a single-layer, 360 degree retainer ring, according to an embodiment;

FIG. 14 is a schematic perspective view illustrating a single sectioned retainer having a wavy region, according to an embodiment;

FIG. 15 is a schematic perspective view of multiple fairings attached to a hanger utilizing both a single-layer, 360 degree retainer ring topped with a plurality of sectioned retainers having wavy regions, according to an embodiment;

FIG. 16 is a schematic perspective view of multiple fairings attached to a hanger utilizing both a single-layer, 360 degree retainer ring topped with a plurality of sectioned retainers having wavy regions, according to an embodiment;

FIG. 17 is a schematic perspective view of a segmented retainer having a wavy region, according to an embodiment;

FIG. 18 is a schematic perspective view of the wavy region of a segmented retainer, according to an embodiment;

FIG. 20 shows an exemplary tool for installing and removing the retention members shown in FIGS. 19*a* through 19*d*.

DETAILED DESCRIPTION OF THE INVENTION

Figure 1:
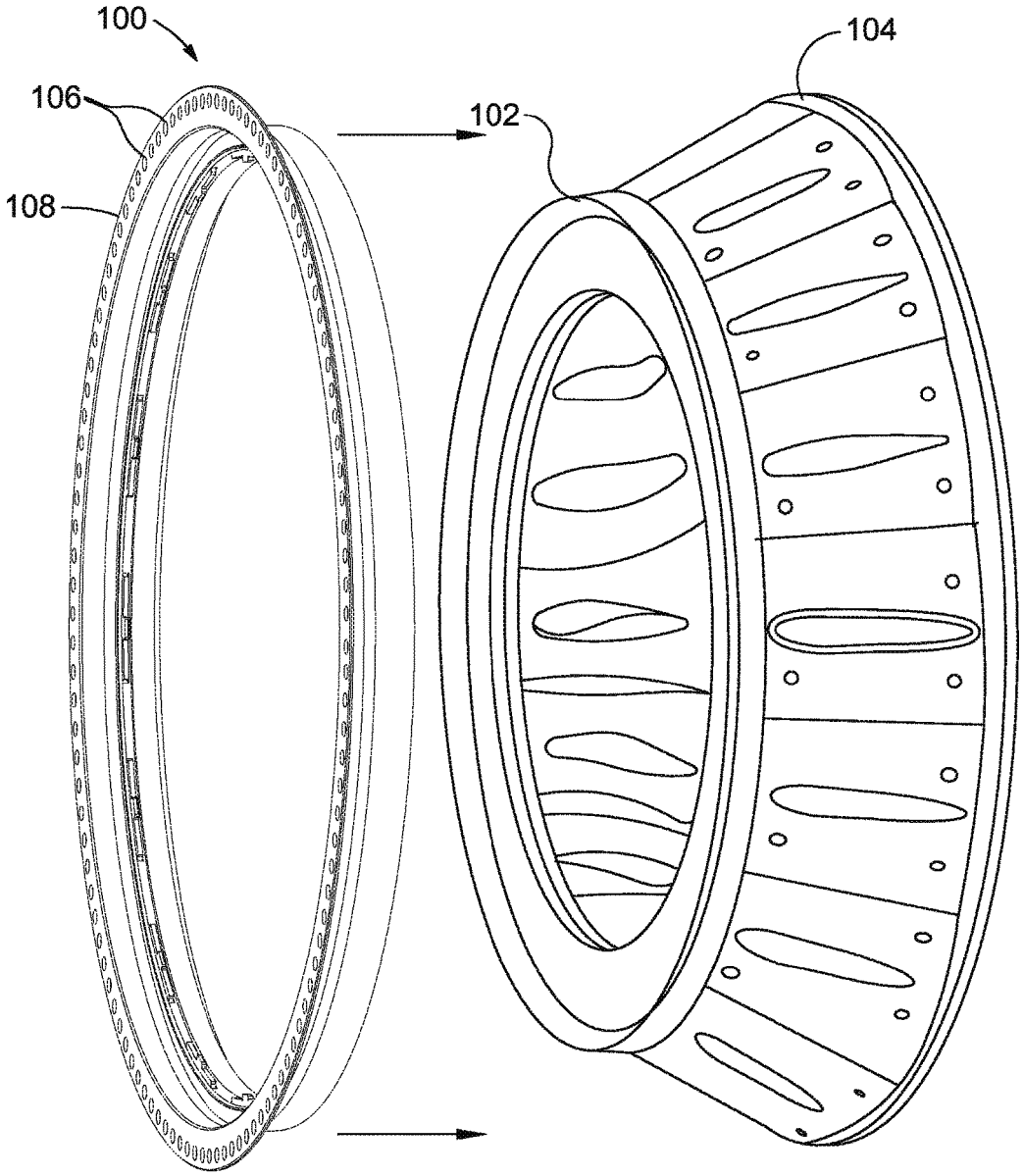
Figure 2:
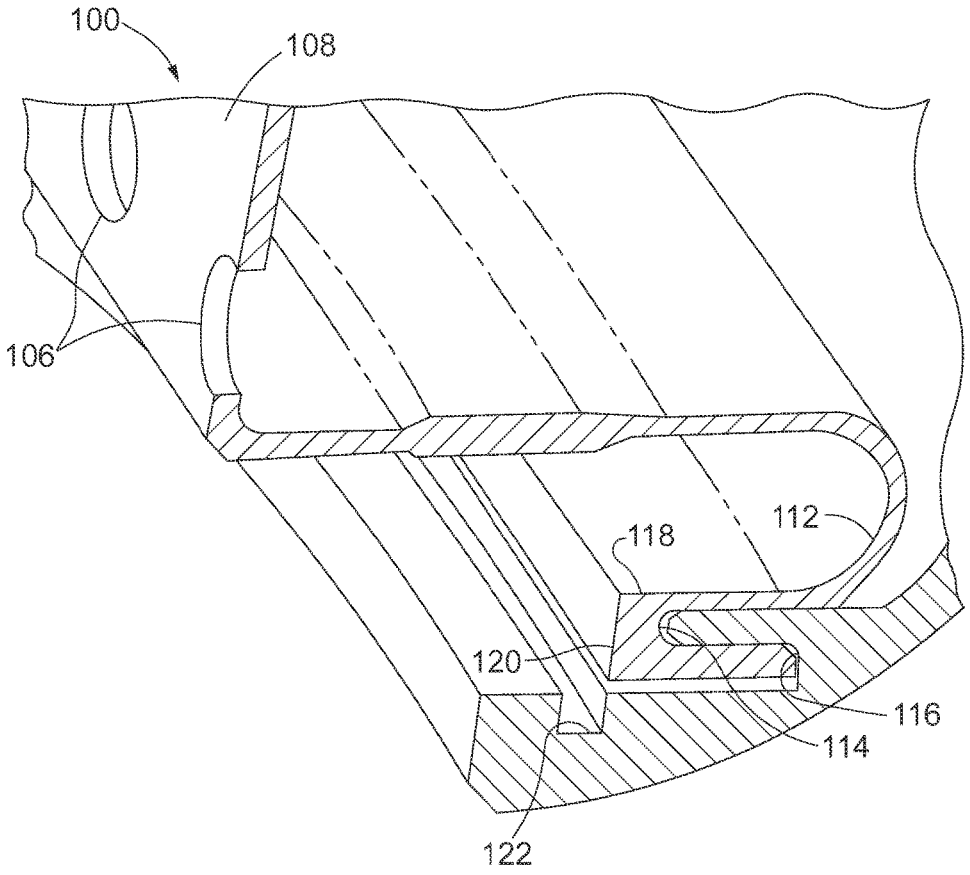

FIG. 1 is a schematic perspective view of a hanger 100 positioned to abut a front end 102 of a collection of fairings 104 aligned in a circular fashion. The illustrated hanger 100 is shown with a plurality of apertures 106 extending through a front flange 108 for attaching the hanger 100 to a frame 110 of a turbine engine. As shown in FIG. 2, the hanger arm 112 of the hanger 100 has a hook channel 114 having a substantially j-shaped cross section, for receiving a fairing circumferential hook 116 of a fairing 104. About a bend portion 118 of the hanger arm 112 is located an annular flat surface 120 that lines up vertically with a fairing circumferential retainer groove 122 in the fairing 104 when the hanger 100 is positioned as shown, such that the hook channel 114 of the hanger 100 is mated with the circumferential hook 116 of the fairing 104. The retainer groove 122 is for receiving an axial retention member 124, which may be a continuous ring with a single break in it, a continuous ring that substantially comprises a spiral having multiple rotations, a series of segmented retainers, and combinations thereof. The retention member 124 is placed in the retainer groove 122 so that the retention member 124 prevents the fore and aft movement of the fairing 104, and the retention member 124 thereby prevents the hook channel 114 of the hanger 100 from separating from the circumferential hook 116 of the fairing 104. Although a fairing 104 is shown as the flow path component in these exemplary embodiments, it should be recognized by one skilled in the art that any flow path component could take the place of the fairing 104.

Figure 3:
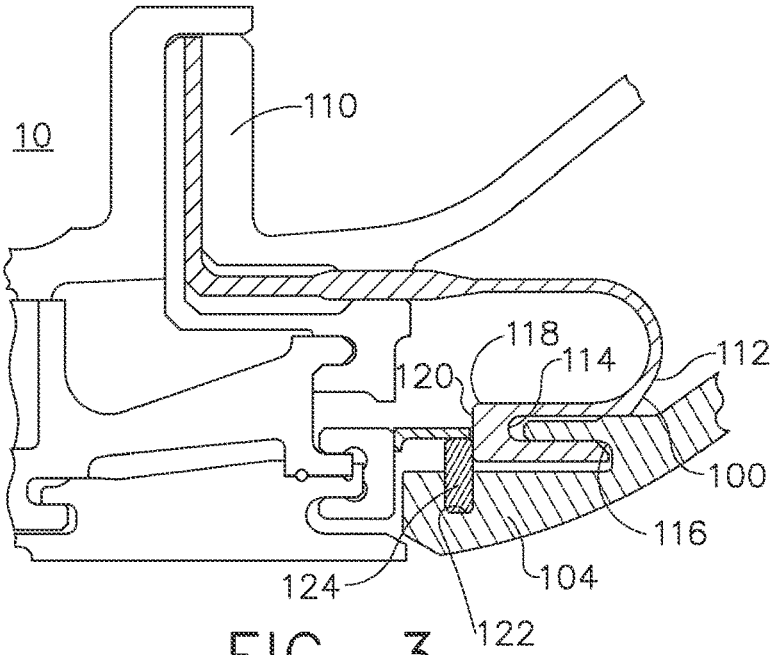

As shown in FIG. 3, mechanical entrapment of the hook channel 114 in the circumferential hook 116 of the fairing 104 is accomplished by placing the retention member 124 in the retainer groove 122. A c-clip 126 is then installed adjacent the retention member 124, wherein the c-clip 126 has a horizontal tab 128 extending away from the rear of the c-clip 126. When the c-clip 126 is fully engaged, the horizontal tab 128 is positioned to abut an outer surface 130 of the retention member 124 to facilitate restricting movement of retention member 124 within the retainer groove 122.

Figure 4:
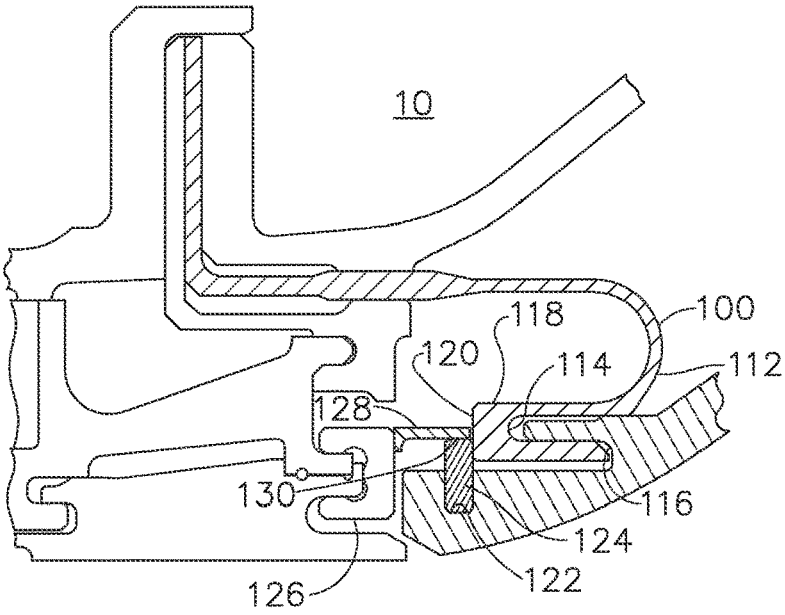

FIG. 4 illustrates an embodiment of the retention member 124 as described above, locked into a circumferential retainer groove 122 in a fairing 104. The retention member 124 shown is a single ply ring, having a fore to aft thickness slightly less than the fore to aft distance between the vertical walls of the circumferential retainer groove 122.

Figure 5:
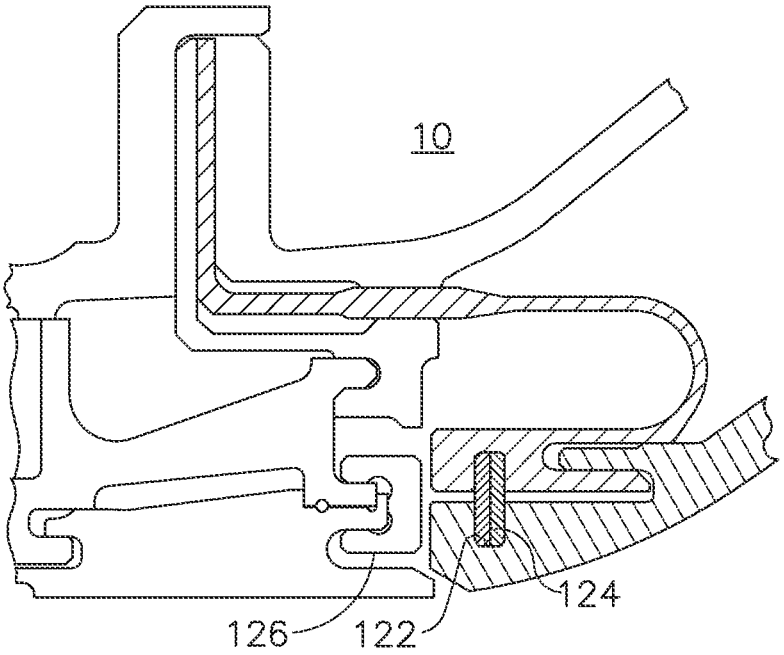
Figure 6:
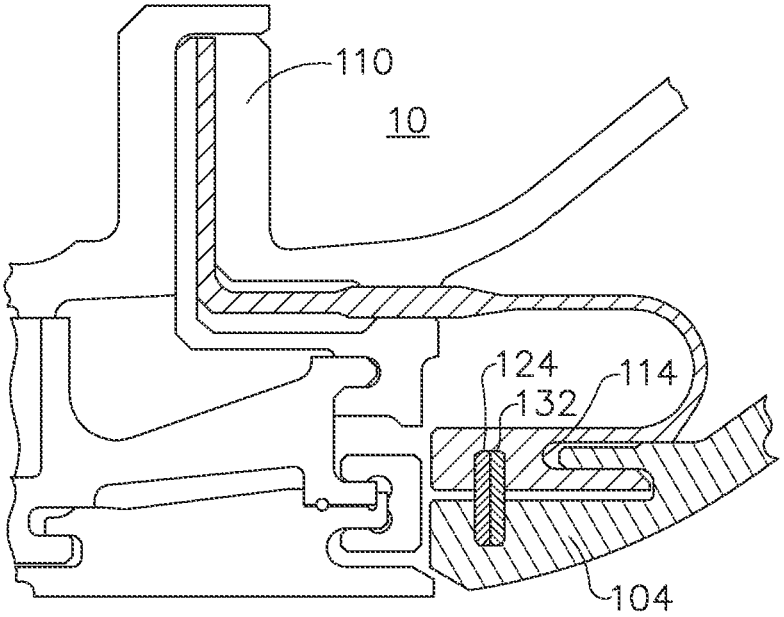
Figure 7:
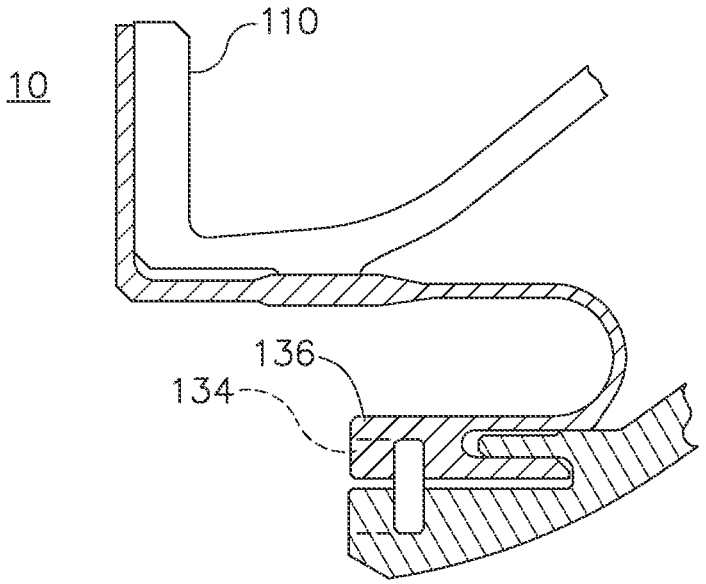
Figure 8:
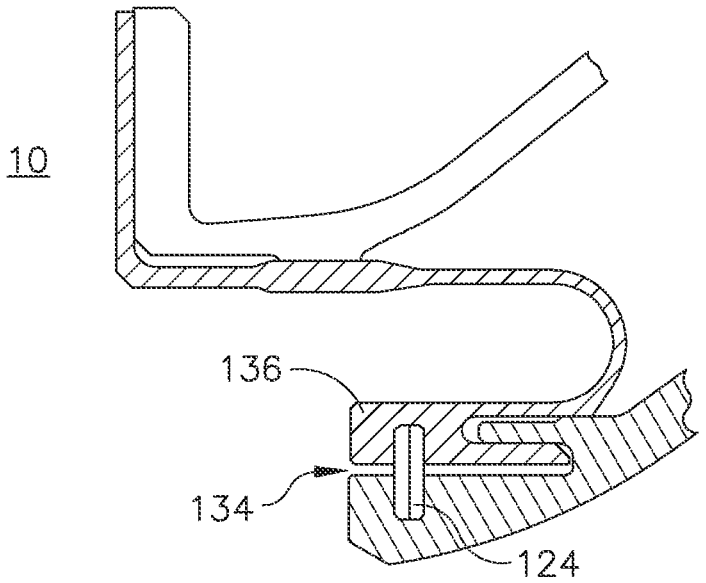

FIGS. 5 and 6 illustrate another embodiment of a turbine frame hanger lock assembly 10. In this embodiment, the retention member 124 is a double ply, spiral ring, having a 720 degree circumference. A hanger located circumferential retainer groove 132 is provided by extending the hanger 100 about the bend portion 118 of the hanger arm 112, so that the channel of the hanger located circumferential retainer groove 132 substantially mates with the channel 123 of the circumferential retainer groove 122 in the fairings 104.

Figure 9:
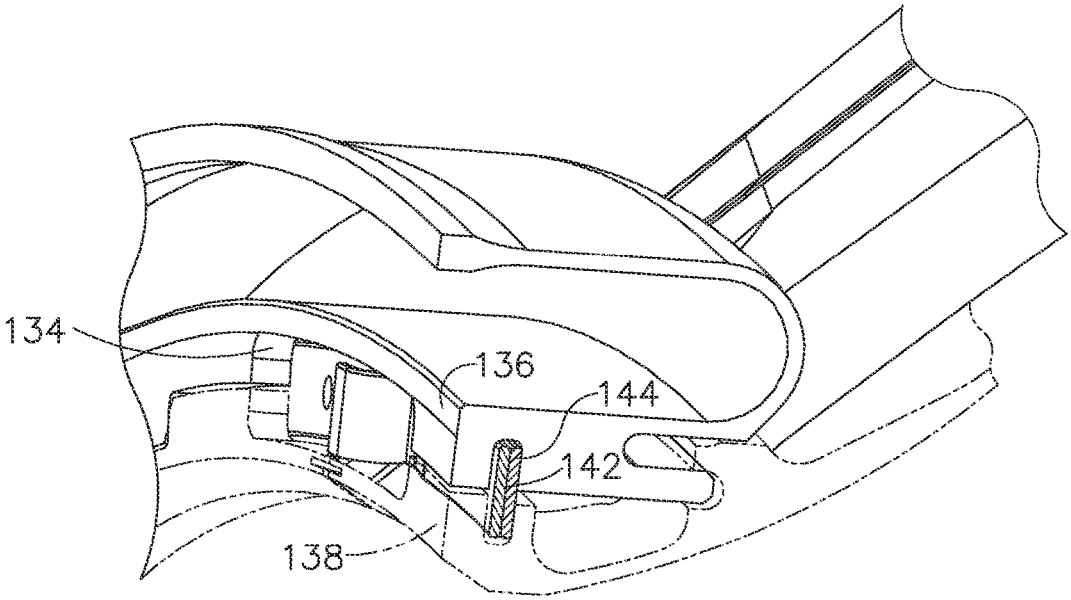

FIGS. 7 through 10 illustrate a scalloped opening 134 in the forward side 136 of the hook channel 114 and the forward side 138 of the fairing. FIG. 9 illustrates the scalloped opening 134 and shows that the opening 134 has a predetermined width for receiving a first end 140 of a multi-turn retention member 142. The first end 140 of the multi-turn retention member 142 is inserted into the scalloped opening 134 and the multi-turn retention member 142 is fed around the circumference of the hanger 100, such that the retention member 124 is traveling in an enclosed groove 144. A second end 146 of the ring has a loop that prevents further insertion of the multi-turn ring 142 into the enclosed groove 144.

Figure 10:
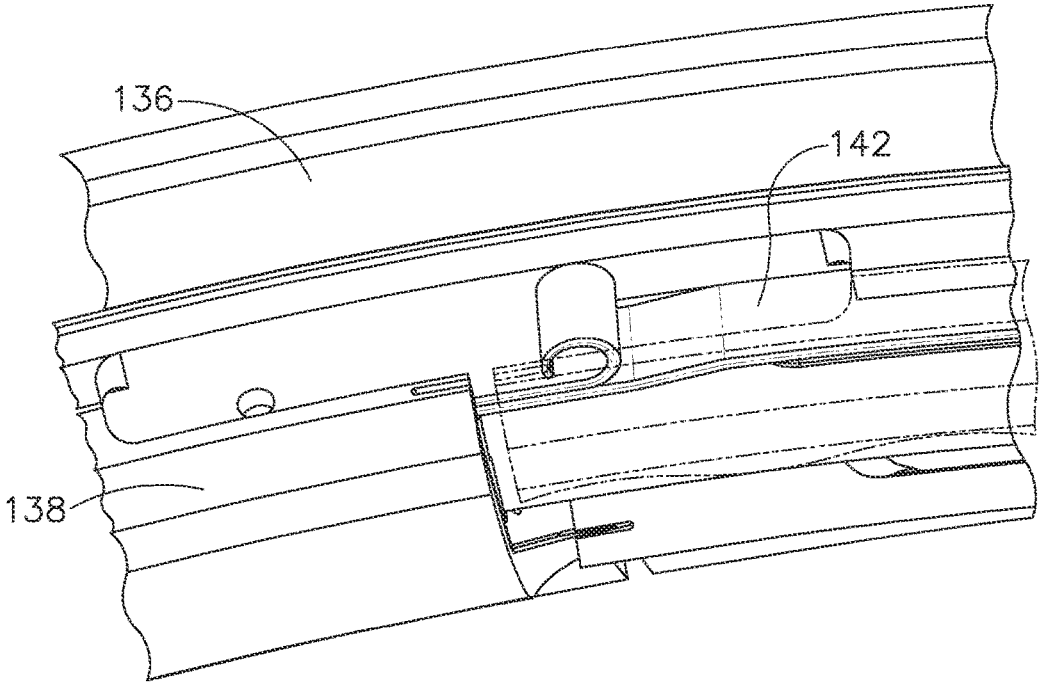
Figure 11:
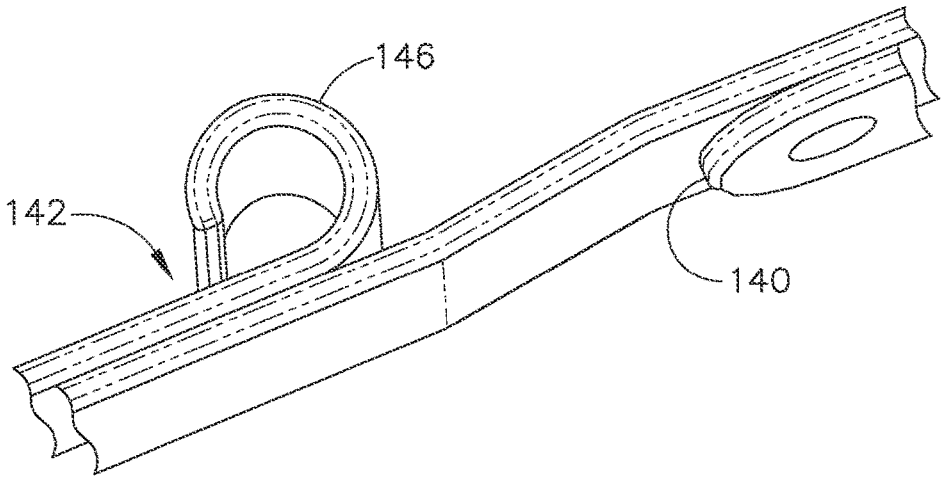

As shown in FIG. 10, the loop of the second end 146 is configured to be less than the width of the scalloped opening 134 so that the loop can be contained within the scalloped opening 134 when the multi-turn retention member 142 is fully inserted into the enclosed groove 144. FIG. 11 illustrates the configuration of the multi-turn retention member 142 having a spiral shape.

Figure 12:
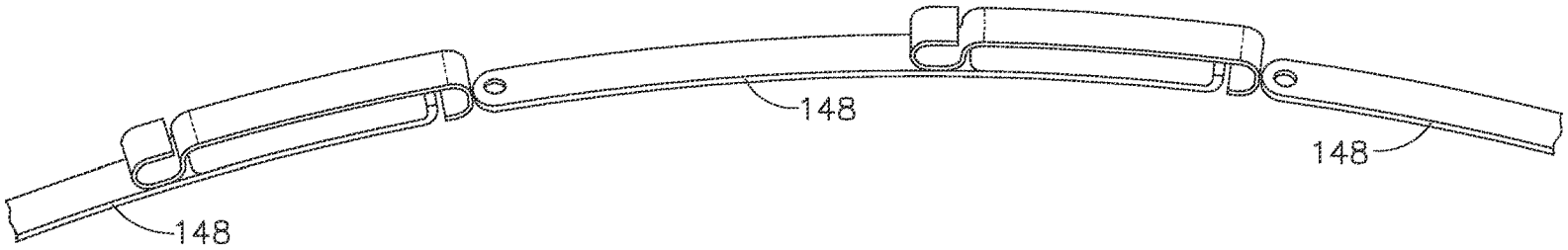
Figure 13:
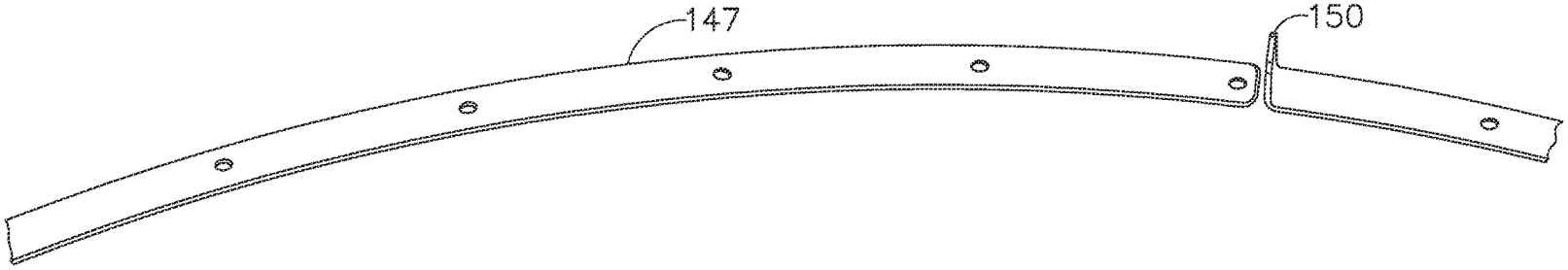

FIGS. 12 and 13 illustrate a hybrid retaining ring configuration including a first retaining ring 147 (as shown in FIG. 13) that extends one full circumference (approximately 360 degrees) around the enclosed groove 144. A bent portion 150 at one end of the first retaining ring 147 prevents the ring from being inserted too far into the enclosed groove 144 and facilitates removal of the first retaining ring 147 therefrom. A second set of segmented retainers 148 (as shown in FIG. 12) is then installed on top of the first retaining ring 147, such that each of the set of segmented retainers 148 extends around less than the full circumference of the channel. As illustrated in FIG. 12, each of the set of segmented retainers 148 extend a fraction of the circumference of the enclosed groove 144.

Figure 14:
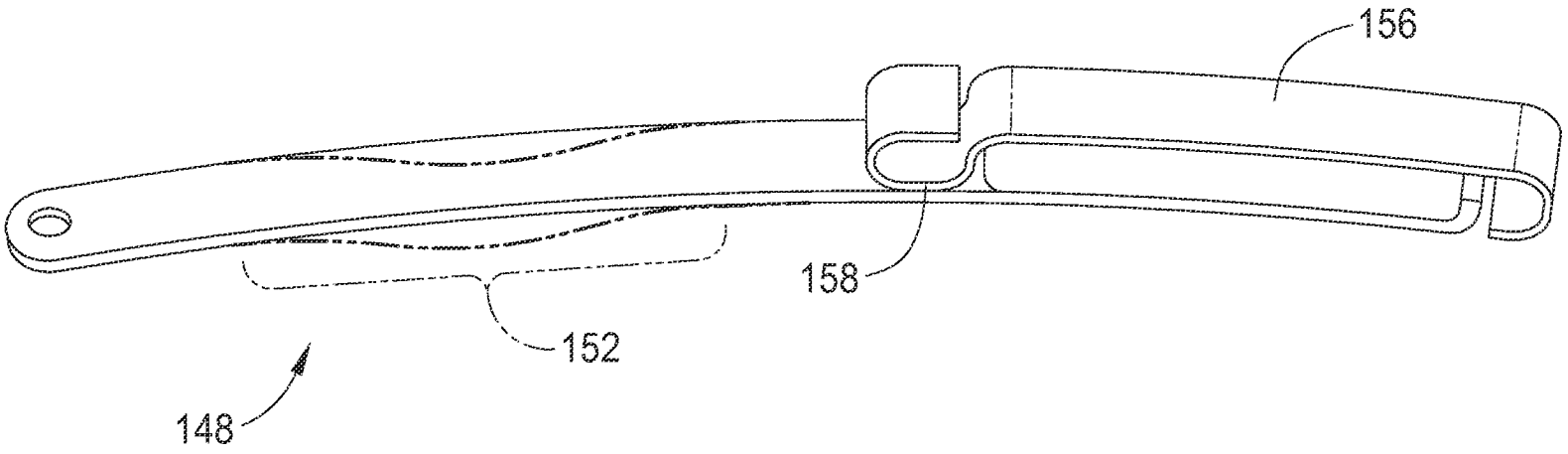

As shown in FIG. 14, each of the set of segmented retainers 148 can have a wavy region 152 (e.g., an axial wave) in them to axially preload the contents of the enclosed groove 144. In this case, the first retainer ring 147 is formed without wavy regions such that the first retainer ring 147 is substantially planar in the plane perpendicular to the axis around which the ring 147 extends. According to an embodiment, each segmented retainer 148 may include a ring layer 154 having a wavy region 152 positioned thereon. A spring clip 156 may be attached to one end of the ring layer 154 for preventing rigid body motion (e.g., circumferential motion). Finally, a spacer 158 is configured to attach the spring clip 156 to a top surface of the ring layer 154. According to another embodiment, each segmented retainer 148 may include a layer 154 having a wavy region 152, and an integrated spring clip 160.

Figure 15:
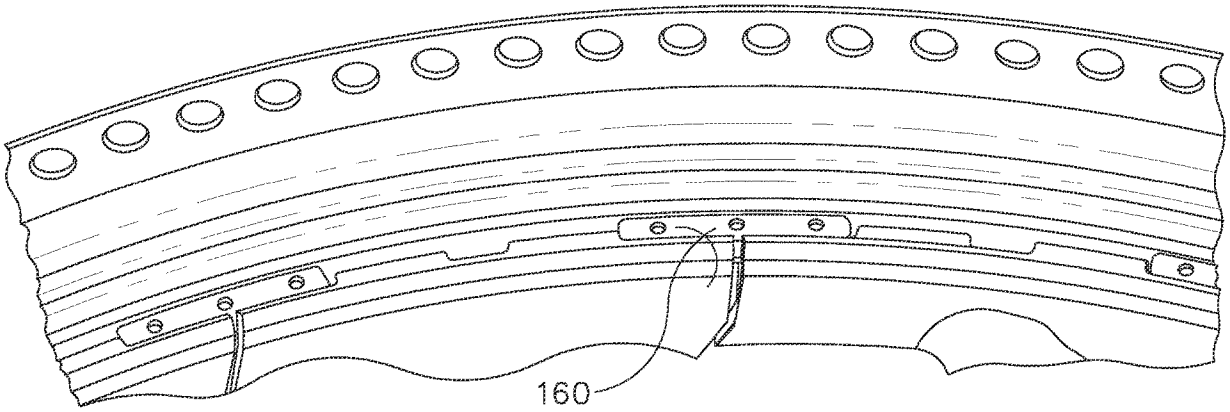
Figure 16:
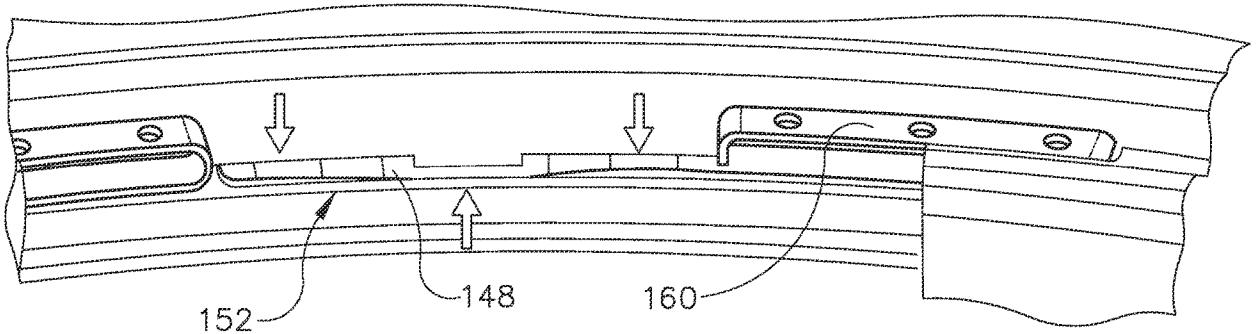
Figure 17:
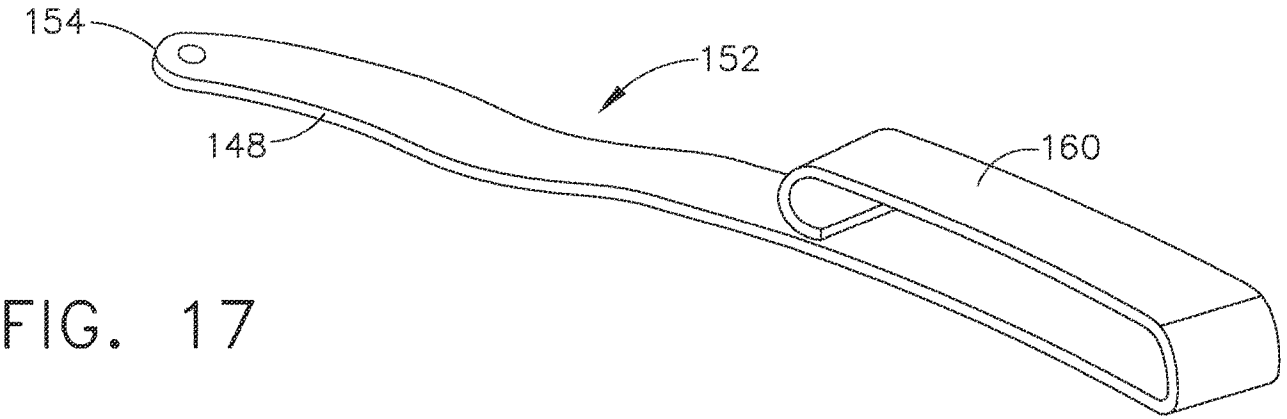
Figure 18:
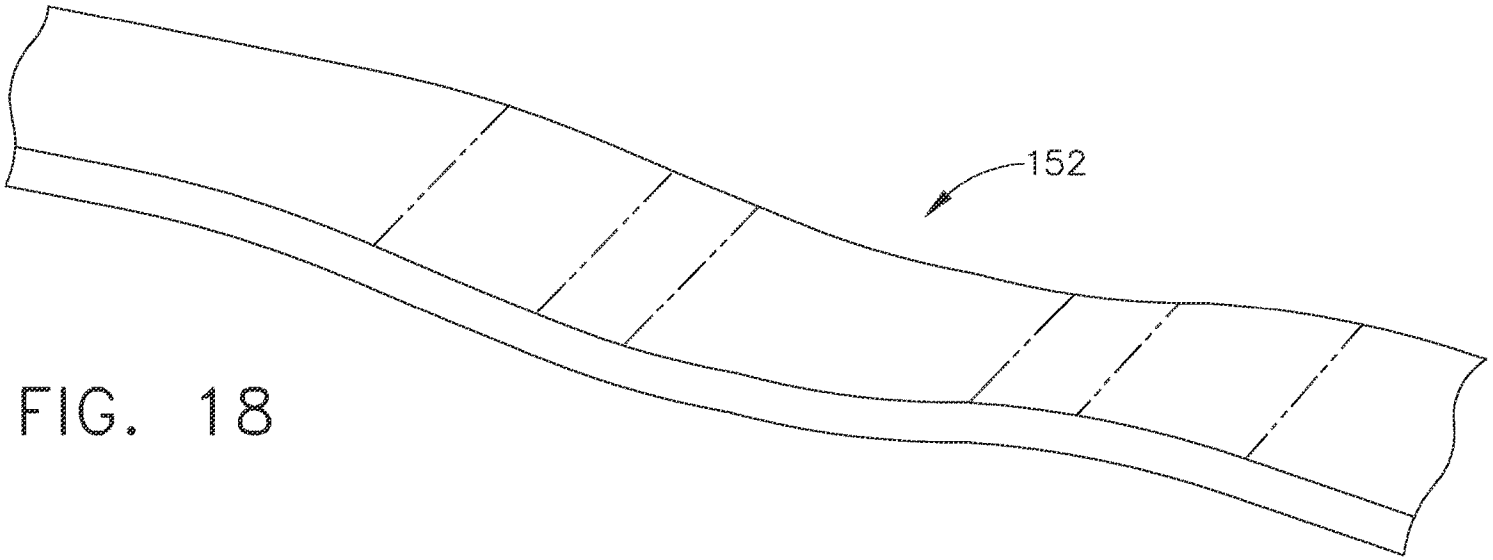

In one embodiment, the sets of segmented retainers 148 is inserted into the channel as shown in FIGS. 15 and 16, through the scalloped openings 134, such that each segmented retainer 148 with a wavy region 152 axially preloads the channel, preventing axial (e.g., fore and aft) movement of the first retaining ring 147 and each of the segmented retainers 148. The interface between the hanger 100 and the fairings 104 forms the scalloped openings 134 such that there is one scalloped opening 134 formed when two fairings 104 are placed side-by-side and a hanger 100 is positioned adjacent the fairings 104, as shown in FIG. 15. The wavy region 152 of each of the set of segmented retainers 148 is illustrated in FIGS. 17 and 18.

Figures 19A, 19B, 19C, 19D:
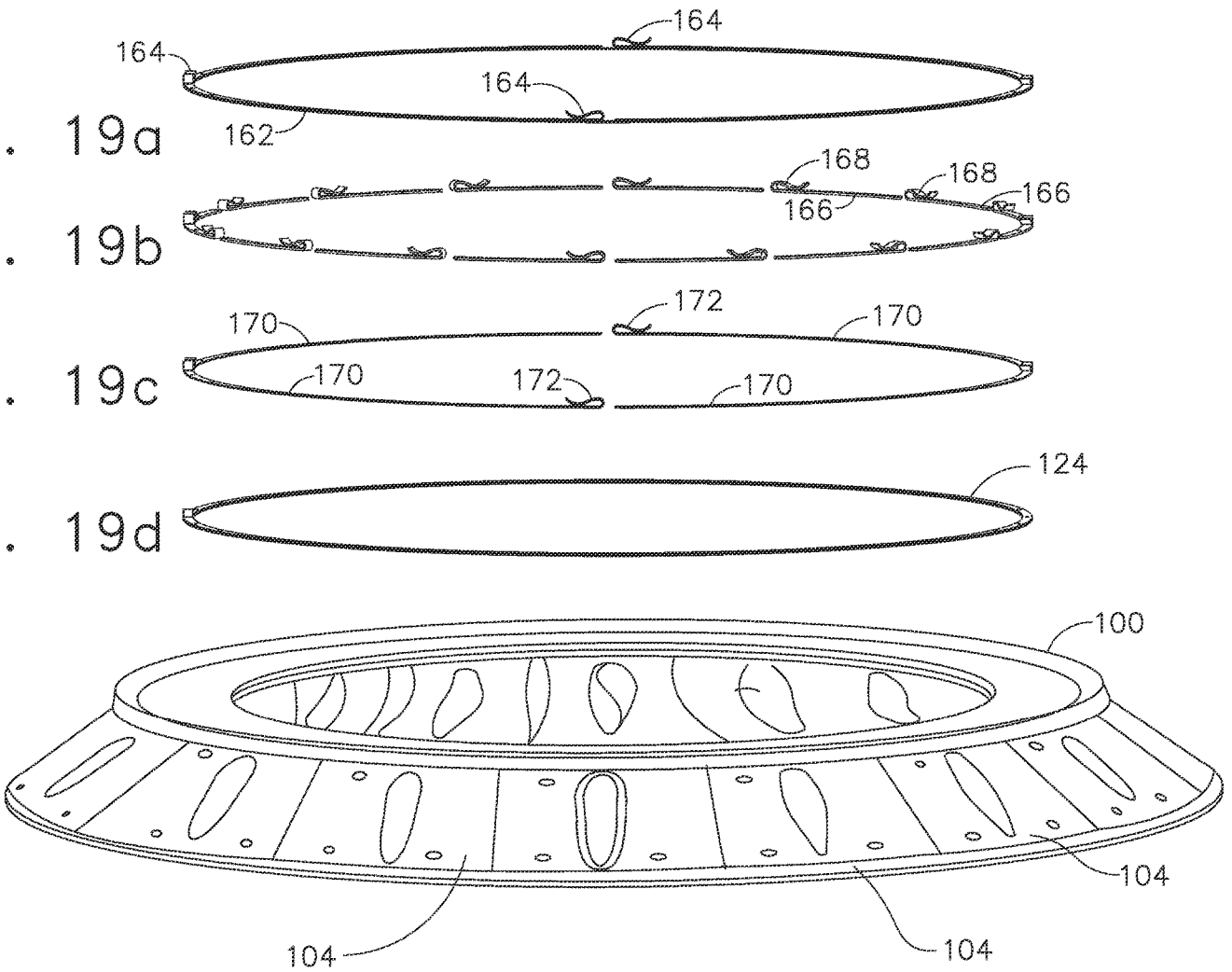
FIGS. 19*a* through 19*d* illustrate various configurations of retention members for retaining a hanger to a plurality of fairings, according to an embodiment.

FIGS. 19*a* through 19*d* illustrate various alternative configurations for retention members. In FIG. 19*d*, the continuous multi-turn retention member 124 is illustrated.

FIG. 19*a* illustrates a hybrid retention member configuration including a first retention member 162 that extends one full circumference around the channel, and a second set of segmented retainers 164 that are inserted through scalloped openings 134 adjacent the first retention member 162, such that each of the retention members 164 extend one quarter of the circumference of the hanger 100.

FIG. 19*b* illustrates a ring configuration including sixteen ring portions 166 that each extend one-sixteenth of the circumference of the hanger 100. Each ring portion 166 is inserted through a scalloped opening 134 to extend within the enclosed groove 144 until the loop 168 prevents further insertion.

FIG. 19*c* illustrates a retention configuration including four retention member portions 170 that each extend one-fourth of the circumference of the hanger 100. Each retention member portion 170 is inserted through a scalloped opening 134 to extend within the enclosed groove 144 until the loop 172 prevents further insertion.

Figure 20:
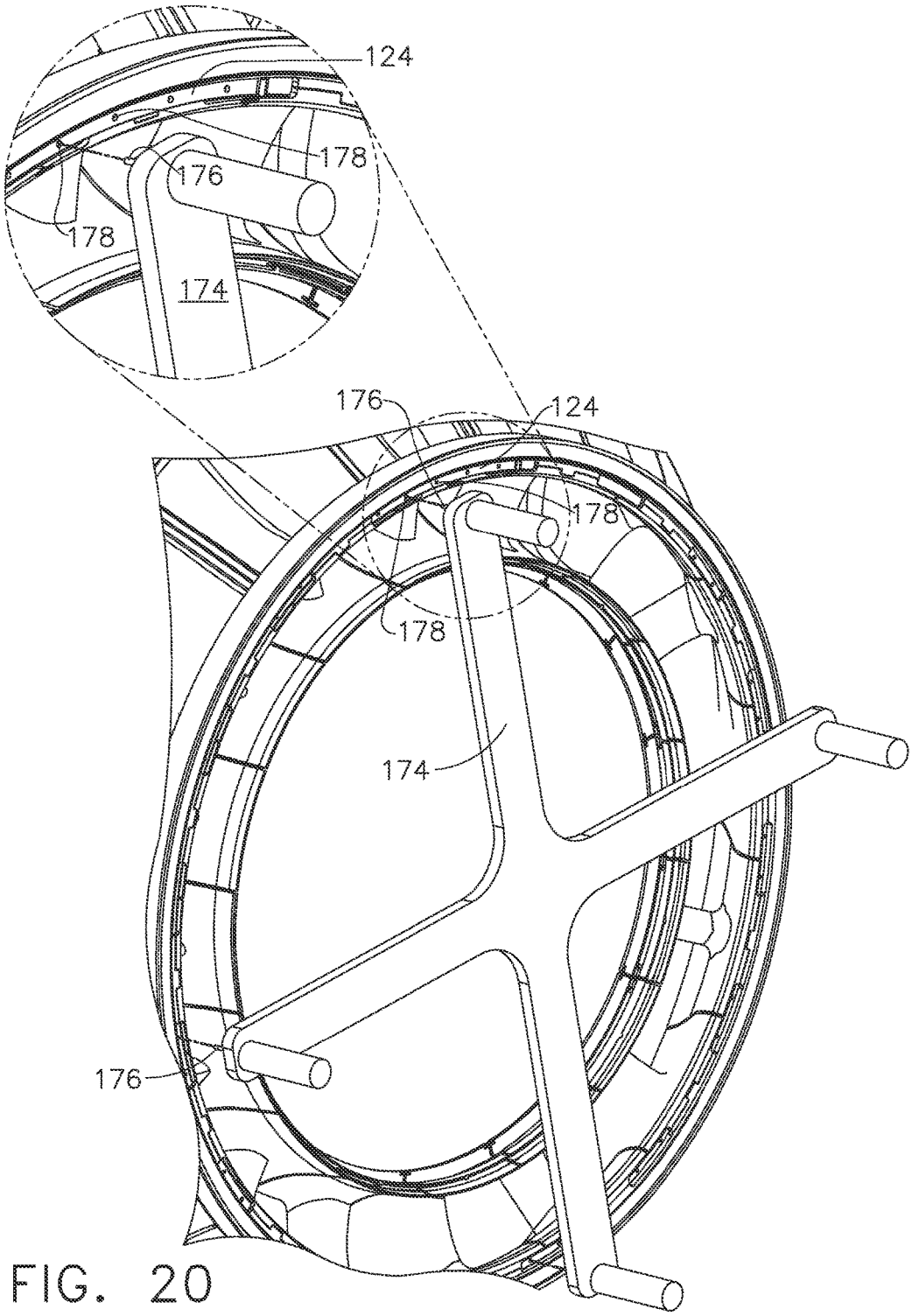

FIG. 20 shows an X-shaped tool 174 for installing and removing a retention member 124 or segmented retainer. The X-shaped tool 174 has four advancing pins 176 for insertion into apertures 178 in the retention member 124 or segmented retainer. During installation of the retention member 124 or segmented retainer, a portion of the retention member 124 or segmented retainer is bent in the direction opposite the scalloped opening, until the retention member 124 or segmented retainer is fully installed in the scalloped opening. Because of this bend in the retention member 124 or segmented retainer, an advancing pin 176 of the X-shaped tool 174 can be inserted into a given aperture so that the X-shaped tool 174 is rotated in a counter clockwise manner, pushing the retention member 124 or segmented retainer into the scalloped opening. When a downstream aperture is nearly inserted into the scalloped opening, another of the advancing pins 176 engages an upstream aperture to continue installation. Once the entire retention member 124 or segmented retainer is inserted into the scalloped opening, the X-shaped tool 174 is removed. By reversing the direction of rotation of the X-shaped tool 174, a retention member 124 or segmented retainer can be removed from the scalloped opening.

Exemplary embodiments of a turbine hanger lock assembly and methods of assembling the turbine hanger lock assembly are described above in detail. The assembly and method are not limited to the specific embodiments described herein, but rather, components of the assembly and/or steps of the method may be utilized independently and separately from other components and/or steps described herein. Further, the described assembly components and/or the method steps can also be defined in, or used in combination with, other assemblies and/or methods, and are not limited to practice with only the assembly and/or method as described herein.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine assembly, comprising:

a hanger having a front flange, a hanger arm extending from the front flange and having a U-shape, and an inner radial hanger bend portion extending from the hanger arm and defining a hook channel therein, the hook channel being oriented in a direction opposite of the hanger arm;

a fairing assembly having an outer surface, a hook member extending from the outer surface to mate with the hook channel, and a circumferential groove defined in the outer surface such that at least a portion of the hanger bend portion is positioned between the circumferential groove and the hook member;

a retention member received in the circumferential groove, wherein the retention member extends from the circumferential groove and presses against the hanger bend portion to facilitate maintaining the hook member within the hook channel; and wherein the front flange includes a plurality of apertures extending therethrough for attaching the hanger to a frame of a turbine engine.

2. The assembly in accordance with claim 1, wherein said retention member comprises an annular ring that extends at least a full circumference about the circumferential groove.

3. The assembly in accordance with claim 2, wherein said annular ring comprises a multi-turn ring having at least two rotations within the circumferential groove, wherein the hook channel further comprises a substantially j-shaped cross section, and wherein the multi-turn ring comprises a spiral shape.

4. The assembly in accordance with claim 3, wherein said retention member comprises:

a segmented retainer sized for insertion in the circumferential groove, wherein said segmented retainer has a thickness that fits between said annular ring and the circumferential groove, wherein the system further comprises a spring clip, the spring clip being integrated with the segmented retainer and preventing circumferential movement of the segmented retainer.

5. The assembly in accordance with claim 1, wherein said retention member has a thickness that fits the retention member within the circumferential groove.

6. The assembly in accordance with claim 1, wherein said retention member comprises a segmented retainer that extends less than a full circumference of the circumferential groove, and wherein said segmented retainer extends one-sixteenth of the circumference of the hanger.

7. The assembly in accordance with claim 6, wherein said segmented retainer comprises a wavy region configured to preload said retention member within the circumferential groove, the assembly further comprising a spring clip attached to said segmented retainer to prevent circumferential movement of the segmented retainer.

8. A turbine assembly comprising:

a frame that has a flange;

a hanger having a front flange abutting the flange of the frame and connected thereto, a hanger arm extending from the front flange and having a U-shape, and an inner radial hanger bend portion extending from the hanger arm and defining a hook channel therein, the hook channel oriented in a direction opposite of the hanger arm;

a fairing including an outer surface, a hook member extending from said outer surface to mate with said hook channel, and a groove defined in said outer surface such that a first portion of said hanger bend portion is positioned between said groove and said hook member; and a retention member received in said groove, wherein said retention member extends from said groove and presses against said hanger bend portion to facilitate maintaining said hook member within said hook channel.

9. The assembly in accordance with claim 8, wherein said hanger bend portion comprises a surface that aligns with said groove such that said retention member extends from said groove to press against said surface.

10. The assembly in accordance with claim 9 further comprising a tab coupled to said retention member to maintain insertion of said retention member within said groove.

11. The assembly in accordance with claim 10, wherein said retention member is positioned vertically between said tab and said groove when said tab is coupled thereto, the assembly further comprising a c-clip, the c-clip adjacent the tab such that the tab is horizontally positioned between the hanger bend portion and the c-clip.

12. The assembly in accordance with claim 8, wherein a second portion of said hanger bend portion extends past said groove, wherein said second portion comprises a groove defined therein that aligns with said groove in the fairing to form an enclosed groove.

13. The assembly in accordance with claim 12, wherein said hanger bend portion substantially aligns with said fairing to form a scalloped opening that is configured to receive said retention member there through for insertion into said enclosed groove.

14. The assembly in accordance with claim 13, wherein said retention member comprises a first end sized for insertion into said scalloped opening, wherein said retention member is fed through said scalloped opening to insert said retention member into said enclosed groove.

15. The assembly in accordance with claim 14, wherein said retention member comprises a locking mechanism defined at an opposing second end of said retention member, wherein said locking mechanism facilitates limiting rotation of said retention member within said enclosed groove.

* * * * *